US005709527A

United States Patent [19]

Ernst et al.

[11] Patent Number: 5,709,527

[45] Date of Patent: Jan. 20, 1998

[54] VIBRATION DAMPING FOR TURBINE BLADES

[75] Inventors: Peter Ernst, Niederglatt; Jakob Rhyner, Zürich, both of Switzerland

[73] Assignee: ABB Research Ltd., Zurich, Switzerland

[21] Appl. No.: 558,858

[22] Filed: Nov. 16, 1995

[30] Foreign Application Priority Data

Feb. 17, 1995 [DE] Germany ..... 195 05 389.3

[51] Int. Cl.[6] ..... F01D 17/00

[52] U.S. Cl. ..... 415/10

[58] Field of Search ..... 415/10

[56] References Cited

U.S. PATENT DOCUMENTS

| | | | |
|---|---|---|---|
| 3,185,441 | 5/1965 | Reuter . | |
| 4,295,803 | 10/1981 | Barthelmess | 415/10 |
| 4,809,354 | 2/1989 | Kawashima | 415/10 |
| 5,490,759 | 2/1996 | Hoffman | 415/10 |

FOREIGN PATENT DOCUMENTS

| | | | |
|---|---|---|---|
| 489861 | 1/1953 | Canada | 415/10 |
| 1299004 | 7/1969 | Germany . | |
| 601436 | 4/1978 | U.S.S.R. | 415/10 |
| 1109540 | 8/1984 | U.S.S.R. | 415/10 |

*Primary Examiner*—John T. Kwon

*Attorney, Agent, or Firm*—Burns, Doane, Swecker & Mathis

[57] ABSTRACT

In a device for damping blade vibrations of an axial-flow turbomachine, the ends of the rotating blades form a seal toward the flow-limiting wall of a turbine casing. A ring of permanently magnetic material is attached to this flow-limiting wall of the turbine casing in the radial direction opposite the blade ends, which ring consists of at least one or more sectional rings of the same or different magnetic polarization. The blade ends are each provided with a cover plate which is made of a material which is a good electrical conductor.

8 Claims, 1 Drawing Sheet

VIBRATION DAMPING FOR TURBINE BLADES

DISCUSSION OF FIELD OF THE INVENTION

The invention relates to a device for damping blade vibrations of an axial-flow turbomachine, in which the ends of the rotating blades form a seal toward the flow-limiting wall of a turbine casing.

DISCUSSION OF BACKGROUND

In turbomachines the rotating blades are designed to be resonance-free for a certain zone of the operating conditions. Stochastic vibrations are produced in the blades by varying operating conditions, e.g. volumetric flow changes in the flowing working medium or back-pressure operation in the limit range. In the event of vibration resonance, these mechanical stresses lead to the failure of the blades.

To dampen these vibrations, various devices have been developed which couple the blades to one another and thus act in a vibration-damping manner. Known concepts are, for example, damper wires, damper bolts, blade cover plates and forged-on lugs with pins. DE B 1 299 004 and U.S. Pat. No. 3,185,441 disclose devices of this type for the damping of blade vibrations. Here, the range of uses of the proposed damping means is limited. Bores for accommodating damper wires or damper bolts adversely affect the strength of the blade profiles, and the damper wires and bolts themselves impair the flow properties of the flowing working medium. High centrifugal forces have a disadvantageous effect during damping by means of blade cover plates, which couple adjacent blade heads to one another to form a closed ring and act in a damping manner through friction grip. The construction and machining of these blade cover plates as well as the blade assembly with these cover plates is complicated and expensive on account of the dimensional accuracy required. There is also the fact that, in the damping devices which are based on friction grip of adjacent blades, the required damping is adversely affected by wear of the contact surfaces and therefore inspections are necessary.

SUMMARY OF THE INVENTION

Accordingly, one object of the invention is to provide a novel device for damping vibrations for turbine blades of the type mentioned at the beginning, in which each blade is damped individually and without friction.

According to the invention this is achieved when a ring of permanently magnetic material is attached to the flow-limiting wall of the turbine casing in the radial direction opposite the blade ends, which ring consists of at least one or more sectional rings of the same or different magnetic polarization, and when the blade ends are each provided with a cover plate which is made of a material which is a good electrical conductor.

The advantages of the invention can be seen, inter alia, in the fact that the blades are not coupled to contact surfaces of damping devices rubbing on one another, such as cover plates, damper wires or bolts. In the case of the proposed damping device, the blades are individually damped free of friction and thus free of wear. Furthermore, it is advantageous that the assembly of individual blades is simplified during axial installation in a turbine wheel, since no tangential damping constructions of adjacent blades overlap one another.

It is especially convenient when the blade cover plates are produced from aluminum, since good electrical properties are combined with a low specific weight in this choice of material. Even centrifugal forces of the order of magnitude as occur during known cover plate dampings occur to a reduced extent on account of the substantially smaller and thus lighter cover plate construction of the invention. This means a reduced mechanical stress for the turbine blade.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein an exemplary embodiment of the invention is represented in a simplified manner, and wherein.

Figure 1:
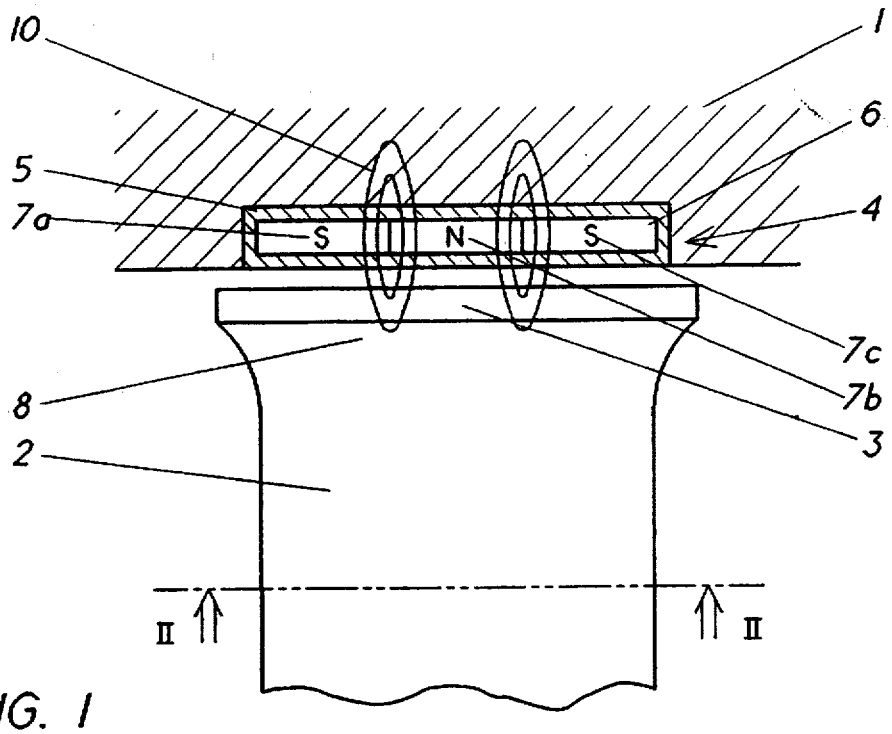
FIG. 1 shows a partial longitudinal section of a blade tip with a magnet ring located radially opposite.

Not shown in the drawing is a turbine-blade root and an assembly view of the blade in a turbine wheel.

DESCRIPTION OF THE PREFERRED EMBODIMENTS

Figure 2:
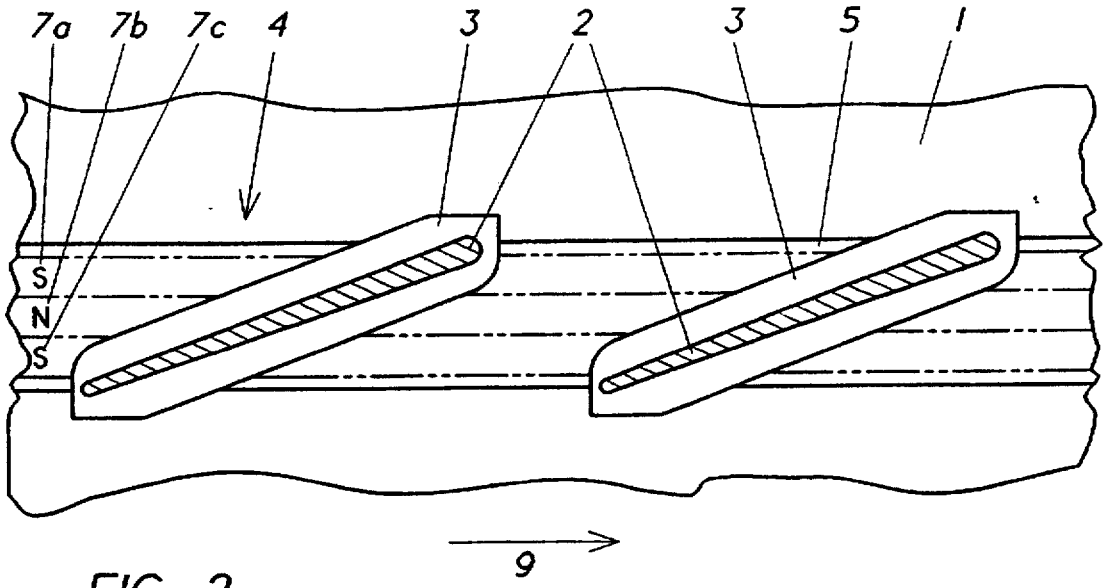
FIG. 2 shows a section along line II—II according to FIG. 1.

Referring now to the drawings, wherein like reference numerals designate identical or corresponding parts throughout the several views, in FIG. 1 a detail of a turbine casing 1 is shown, which is located radially opposite a blade end 8 of a turbine moving blade 2. As is apparent from the supersonic blade profile in FIG. 2, the blade shown is an end blade, for example of an LP steam turbine. A ring 4 of permanently magnetic material is attached in the peripheral direction at the designated point of the turbine casing 1 around a bladed turbine wheel (not shown). This magnet ring 4 consists of sectional rings 6 which are assembled in a housing 5 of austenitic steel and are fastened with the latter in the turbine casing 1. In this arrangement, the magnet ring 4 is subdivided into three sectional rings 6 having magnetic polarization 7*a, b, c* alternating with one another, the polarization scheme being SNS. The turbine blade 2 radially opposite the magnet ring 4 has a cover plate 3 at its blade end 8, as FIG. 2 shows. In radial plan view, this cover plate 3 has approximately the shape of a rhombus, the acute-angled corners of which are flattened parallel to the direction of rotation 9 of the turbine blades 2. The blades 2 are free-standing, i.e. the cover plates 3 of adjacent blades 2 are dimensioned in such a way that they do not overlap tangentially and do not touch one another.

When the turbine wheel (not shown) rotates in the direction of rotation 9, the magnetic field 10 of the permanent-magnet ring 4 for the blade cover plate 3 remains constant as long as the blade 2 does not perform any vibratory movement. If the turbine blade 2 vibrates, however, the magnetic flux in the blade cover plate 3 is variable with time. This magnetic flux, which is variable with time, induces eddy currents in the blade cover plate 3 which lead to the production of a Joule effect. This energy dissipation results in damping of the blade vibration. The Joule effect and thus the damping effect increase with the electrical conductivity of the material of the cover plate.

A preferred alloy for the permanent-magnet ring 4 is cobalt-samarium (Co—Sm). On account of its good electrical properties and the low (for metals) specific weight, it is advantageous to produce the blade cover plate 3 from aluminum. The low specific weight permits easy construction of the cover plate 3 of the blades 2 loaded by centrifugal force. The good electrical conductivity of the aluminum favors the eddy currents and thus, as mentioned above, the damping behavior.

The invention is of course not restricted to the exemplary embodiment shown and described. Thus the number of sectional rings 6 involved in the magnet ring 4 and their magnetic polarization 7*a,b,c* is also conceivable in another configuration, in which case another magnetic material could also be preferred to Co—Sm. Furthermore, the sectional rings 6 can also be embodied as electrically fed toroidal coils. Within the scope of the invention, the embodiment of the blade cover plate 3 in a material other than aluminum is also conceivable. If the higher specific weight of ferromagnetic metals and their alloys is accepted, these materials are likewise extremely suitable for the production of the cover plates. Their magnetic properties are excellent here, which means a considerable reduction in the magnetic air gap between a cover plate and the flow-limiting wall. The dissipated vibration energy can therefore be increased by favoring the magnetic flux in the cover plate. The invention can of course also be used in an additionally damping manner in blade wheels bound by shroud bands.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for damping blade vibrations of an axial-flow turbomachine having a plurality of blades mounted on a rotor, wherein ends of the plurality of blades form seals at a flow-limiting wall of a turbine casing, the device comprising:

a ring of permanently magnetic material attached to the flow-limiting wall of the turbine casing opposite the ends of the plurality of blades, which ring includes at least one sectional ring having a magnetic polarization, and a cover plate mounted on each of the ends of the plurality of blades, the cover plate being made of a material which is a good electrical conductor.

2. The device as claimed in claim 1, wherein the permanent-magnet ring consists of three sectional rings wherein adjacent sectional rings have opposite polarization, and wherein the permanent-magnet ring is surrounded by a nonmagnetic housing.

3. The device as claimed in claim 1, wherein cover plates on adjacent blades do not touch one another.

4. The device as claimed in claim 1, wherein the cover plates of the blades are formed from aluminum.

5. The device as claimed in claim 1, wherein the cover plates of the blades are formed from a ferromagnetic material.

6. The device as claimed in claim 1, wherein the blades and the ring are relatively oriented so that vibration of the blades during rotation induces eddy currents in each of the cover plates.

7. The device as claimed in claim 1, wherein the ring lies in a plane in which the blades of the rotor are positioned to rotate.

8. An axial-flow turbomachine, comprising:

a rotor having a plurality of free-standing blades extending radially therefrom;

a casing enclosing the rotor having a flow-limiting wall radially adjacent to the free ends of the blades;

a plurality of cover plates, one plate mounted on a free end of each of the blades and extending toward the flow-limiting wall to form seals, the cover plates being formed of an electrically conductive material; and, a ring of permanently magnetic material attached to the flow-limiting wall of the turbine casing radially adjacent the cover plates of the blade ends, the ring including at least one sectional ring having a magnetic polarization.

* * * * *